United States Patent [19]

Howard, Jr.

[11] 4,142,716

[45] Mar. 6, 1979

[54] GAMES

[76] Inventor: John W. Howard, Jr., 825 NW. 70th St., #3, Miami, Fla. 33150

[21] Appl. No.: 799,352

[22] Filed: May 23, 1977

[51] Int. Cl.[2] ..... A63F 9/00

[52] U.S. Cl. ..... 273/1 R; 35/22 R

[58] Field of Search ..... 273/1 R, 1 E, 1 M; 35/19 R, 22 R

[56] References Cited

U.S. PATENT DOCUMENTS

| | | | |
|---|---|---|---|
| 1,503,294 | 7/1924 | Bishop | 273/94 R |
| 3,065,963 | 11/1962 | Dean | 273/1 R |
| 3,989,242 | 11/1976 | Shankel et al. | 273/1 R |
| 3,990,698 | 11/1976 | Barlow | 273/1 R |

*Primary Examiner*—Paul E. Shapiro

*Attorney, Agent, or Firm*—Salvatore G. Militana

[57] ABSTRACT

A game played by two persons consisting of a vertically oriented housing having a pivoted indicator actuated by each person for rotating a weighted and imbalanced gear that is brought to a stop by the other person at his discretion, the indicator stopping at one of the numerals that are positioned about the pivoted indicator and symmetrically positioned on opposite sides of an imaginary vertical line through the indicator pivot. These numbers being noted and tallied on pegs mounted on the housing. The winner of the game is the person acquiring a sum total of his numbers that equals exactly the highest or winning number indicated on the housing; otherwise he must continue the game starting with a new talley that is the number in excess of the established winning number.

4 Claims, 4 Drawing Figures

GAMES

BRIEF SUMMARY OF THE INVENTION

The Free Fall Game is a game for two. The game has no wires, springs, coils, cranks or pulleys and requires no physical contact between the players. The game functions off of free gravity. It is a game of dexterity, whereas one must be sharp enough to stop the rapidly descending pointer, by pressing their finger pad so the pointer will stop at the number they wish their score indicator to descend the pegs. It is a very economical and fun game, and should be constructed of a medium type plastic.

An example of a game cited as reference to my invention is disclosed in U.S. Pat. No. 2,165,145 Game Of Skill. You will note that while this Game Of Skill does show rotatable wheels, it does not show the idea of 'Free Fall' and stopping the fall at a desired number.

DETAILED DESCRIPTION OF THE PREFERRED EMBODIMENT

Figure 1:
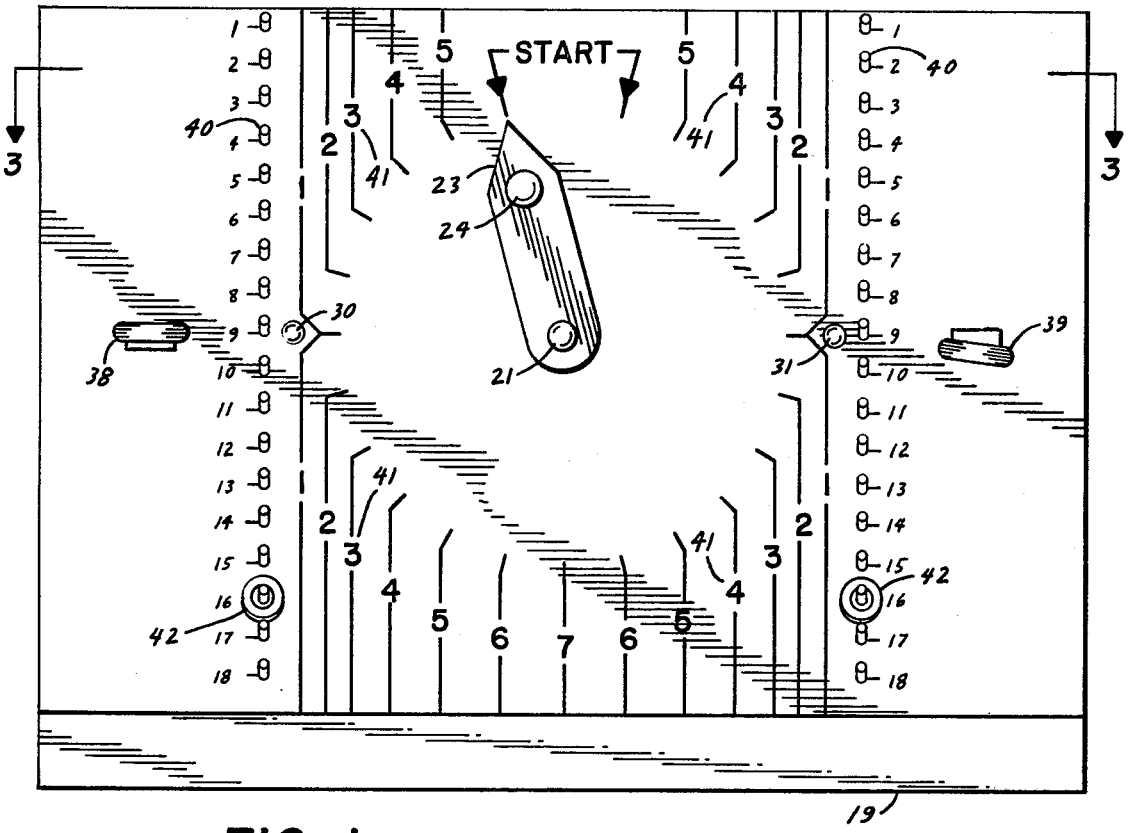
FIG. 1 is a front elevation of the game.
Figure 2:
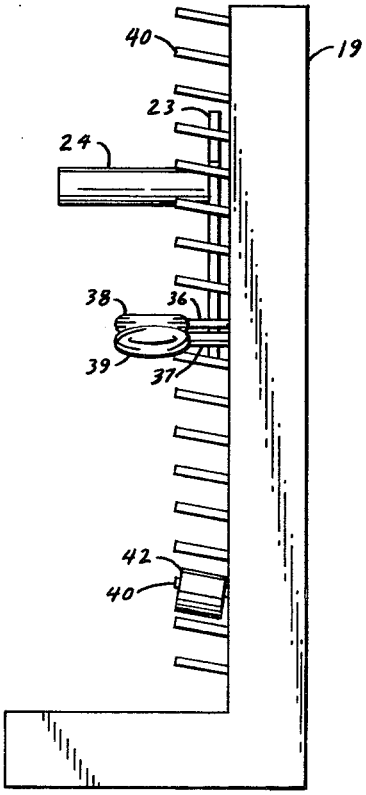
FIG. 2 is a right side elevation view.
Figure 3:
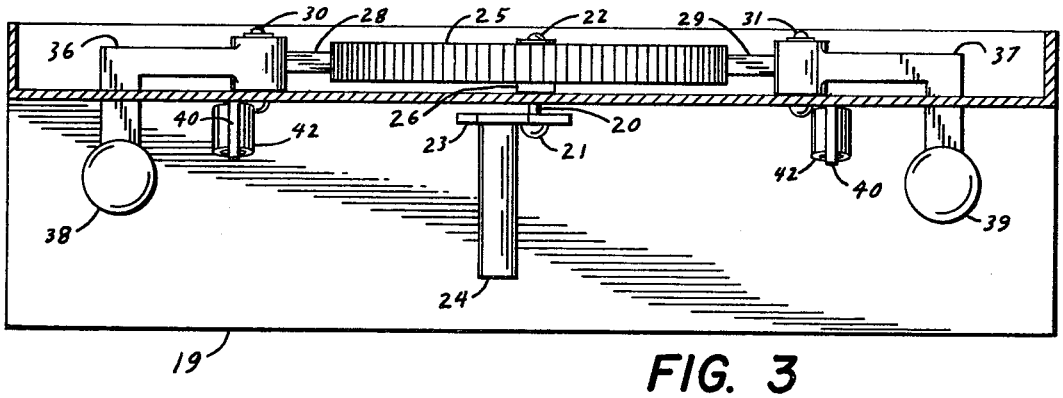
FIG. 3 is a section view taken through three three as shown in FIG. 1.
Figure 4:
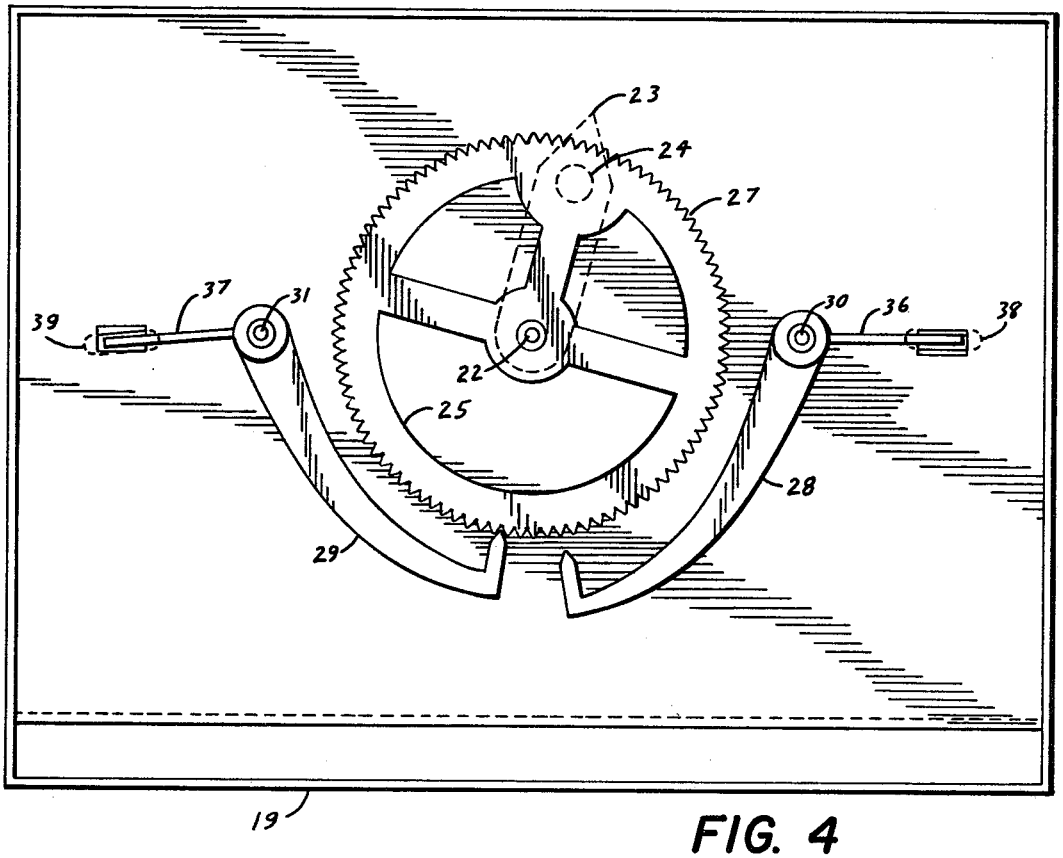
FIG. 4 is a rear elevation view of the game.

The game housing 19 consists of two sides, a top and bottom with an extended base for stability. The game housing 19 supports a common axis 20, secured by caps 21 and 22, respectively. The common axis 20, is centrally located to support the tightly mounted pointer 23 and extender 24 along with notched rotatable wheel 25 tightly mounted on the rear. A spacer 26 is between the notched wheel 25 and housing 19 to prevent friction. The notched wheel 25 has an added weight to one side so that it will rotate by force of gravity to the lower position taking with it the pointer 23 and extender 24. Further the notched wheel 25 has notches 27 about its outer circumference to engage with brakes 28 and 29, which are supported by pivots 30 and 31, respectively. Pivot pins 30 and 31 are secured by rivit type caps on both ends, respectively. Brakers 28 and 29 have 'L ' shaped levers 36 and 37, that extend thru the game housing 19. Each of the 'L' shaped levers 36 and 37, have finger pads 38 and 39 affixed, respectively. Further brakes 28 and 29, when released fall by gravity from contact with the notches 27.

The game housing 19 supports two corresponding sets of eighteen consecutively numbered semi-horizontally attached pegs 40 mounted in the vertical position on each side, and two sets of numbers 41 in a circular position. The pegs 40 support the score indicator 42 for each player.

Referring to FIG. 1 player on right side may commence game by rotating the pointer 23 by the extender 24 to his opponents start position (left), and hold it there by pressing his finger pad 39. Upon his opponents request he releases the finger pad 39, causing the weighted rotating pointer 23 to fall rapidly toward his set of numbers 41 on the left side. The player on the left side must stop the rapidly descending pointer 23 at or close to a number on his side, that he wishes his score indicator 42 to descend to, by pressing his finger pad 38, at the proper time, which engages the braker 28 with notches 27 on the wheel 25. Player on the left now rotates pointer 23 by extender 24 to the right start and holds it there by pressing his finger pad 38. Upon his opponents request he releases the finger pad 38, causing the descending pointer 23 to fall rapidly toward numbers 41 on the right side. The player on the right side must stop the pointer 23 at or close to a number 41 on his side, the number of pegs 40 that he wishes his score indicator 42 to descend to, by pressing his finger pad 39, at the proper time, which engages the braker 29 with the notches on the wheel 25.

The above paragraph procedure is repeated until the player whose score indicator 42 lands on his exact bottom peg 40 wins. Example: If player was two pegs from bottom peg and stopped pointer on #4 he would go back to the top and descend two pegs. Each player starts on his top peg. The pointer can only pass the numbers once.

Thus, having described my invention, I claim:

1. An amusement game comprising, a vertically oriented support surface, a body freely rotatably supported on said surface at a pivot axis, said body having its center of gravity positioned remote from said pivot axis, an indicator secured to said body and rotatable therewith, scoring indicia on said support surface and radially positioned about said pivot axis and symetrically positioned on opposite sides of an imaginary vertical line through said pivot axis, and at least two means for manual actuation by users of the game for individually engaging said body to prevent rotation thereof, whereby said body may be manually rotated to a position with said center of gravity located above said pivot axis and to either side of said vertical line, released to rotate about said pivot axis by the force of gravity, and manually stopped with said indicator adjacent a selected one of said scoring indicia.

2. The structure as recited by claim 1 wherein said rotatable body comprises a wheel mounted on said pivot axis, said wheel having a plurality of notches on its periphery, a pair of pawls, means pivotally mounting said pawls on each side of said wheel and a lever secured to each of said pawls for swinging said pawls into engagement with said notches thereby stopping the rotational movement of said wheel.

3. The structure as recited by claim 2 including means mounted on said surface symmetrically disposed on each side of said pivot axis for indicating scores attained by the participants of said game.

4. The structure as recited by claim 3 wherein score indicating means comprises a plurality of pegs mounted on said board for receiving a ring member and numerical indicia imprinted on said board adjacent each of said pegs.

* * * * *